US006672876B1

(12) United States Patent
Takekoshi

(10) Patent No.: US 6,672,876 B1
(45) Date of Patent: Jan. 6, 2004

(54) PROBE CARD WITH PYRAMID SHAPED THIN FILM CONTACTS

(75) Inventor: Kiyoshi Takekoshi, Nirasaki (JP)

(73) Assignee: Tokyo Electron Limited, Tokyo (JP)

( * ) Notice: Subject to any disclaimer, the term of this patent is extended or adjusted under 35 U.S.C. 154(b) by 531 days.

(21) Appl. No.: 09/634,886

(22) Filed: Aug. 7, 2000

(30) Foreign Application Priority Data

Aug. 19, 1999 (JP) ..... 11-232779

(51) Int. Cl.[7] ..... H01R 12/00
(52) U.S. Cl. ..... 439/66
(58) Field of Search ..... 439/66, 81; 324/754; 174/773, 774

(56) References Cited

U.S. PATENT DOCUMENTS 5,869,974 A 2/1999 Akram et al.
6,007,349 A * 12/1999 Distefano et al. ..... 439/66
6,307,159 B1 * 10/2001 Soejima et al. ..... 439/66
6,359,455 B1 * 3/2002 Takekoshi ..... 439/66

* cited by examiner

*Primary Examiner*—Neil Abrams
(74) *Attorney, Agent, or Firm*—Oblon, Spivak, McClelland, Maier & Neustadt, P.C.

(57) ABSTRACT

Disclosed is a probe card comprising a probe having at thin film-like frame-like base section formed along the lower circumferential surface of an imaginary pyramid having at least a pyramidal top portion, a contact terminal section formed along the outer circumferential surface of the top portion of the imaginary pyramid, and at least one thin film-like joining section having a predetermined shape and serving to join the contact terminal section to the base section. The probe having a triangular pyramidal or conical shape as required.

5 Claims, 7 Drawing Sheets

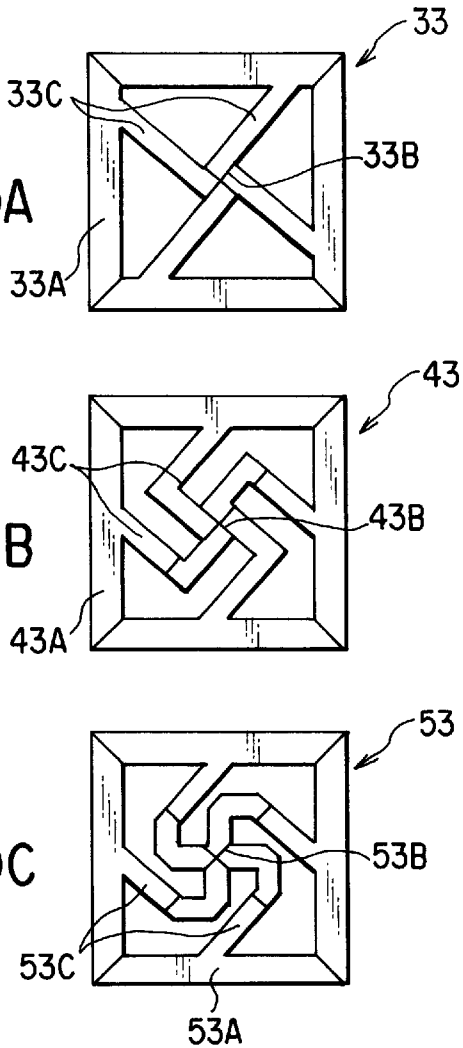
FIG. 10A
FIG. 10B
FIG. 10C
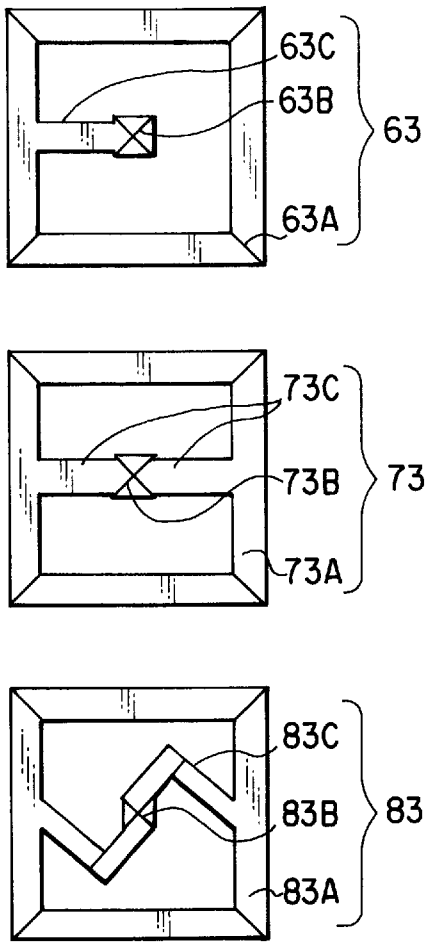
FIG. 10D
FIG. 10E
FIG. 10F

PROBE CARD WITH PYRAMID SHAPED THIN FILM CONTACTS

CROSS-REFERENCE TO RELATED APPLICATIONS

This application is based upon and claims the benefit of priority from the prior Japanese Patent Application No. 11-232779, filed Aug. 19, 1999, the entire contents of which are incorporated herein by reference.

BACKGROUND OF THE INVENTION

The present invention relates to a probe card used in a probe card apparatus used for inspecting the electrical characteristics of a target body to be inspected and a method of manufacturing the same.

The probe apparatus for an integrated circuit formed on a semiconductor wafer W includes generally a loading chamber 91 and a probing chamber 92, as shown in FIGS. 12 and 13. The wafer W is transferred and pre-aligned in the loading chamber 91. The wafer W is transferred from the loading chamber 91 into the probing chamber 92, and the electrical characteristics of the integrated circuits formed on the wafer W are inspected in the probing chamber 92. Tweezers 93 and a sub-chuck 94 are arranged within the loading chamber 91. While the wafer W is being transferred by the tweezers 93, the wafer W is pre-aligned by the sub-chuck 94 on the basis of the orientation flat or a notch of the wafer W. A main chuck 95 and an alignment mechanism 96 are arranged within the probing chamber 92. The main chuck 95 having the wafer W disposed thereon is moved in the X, Y, and θ directions and co-operates with the alignment mechanism 96 to align the wafer W with probes 3 of a probe card 97 arranged above the main chuck 95. The main chuck is moved upward in the Z-direction so as to bring the wafer W into an electrical contact with the probes 3. As a result, the electrical characteristics of the integrated circuit formed on the wafer W are inspected through the probes 3 and a test head T.

The probe card 97 is brought into contact with electrode pads of the IC chips so as to relay the exchange of an inspecting signal between the tester and the IC chips. The probe card is provided with a plurality of probes of a wire type arranged to correspond to, for example, a plurality of electrode pads formed on the IC chips.

BRIEF SUMMARY OF THE INVENTION

In recent years, the degree of integration of the IC chip is increased, and the number of electrode pads is on a sharp increase. Also, the arranging pitch of the electrode pads is made smaller and smaller. As a result, the number of probes of the probe card is also on a sharp increase, and the probes are arranged at a smaller pitch. With increase in the diameter of the wafer, the number of IC chips within the wafer is also on a sharp increase. As a result, a long time is required for inspecting these IC chips. It is of high importance to shorten the time required for the inspection. Such being the situation, the number of IC chips that are inspected simultaneously is increased in an attempt to shorten the inspecting time. As a prove card for dealing with the increase in the number of probes and with the increase in the number of IC chips that are to be inspected simultaneously, known is a membrane type probe card having bump-shaped probes. The probes of the probing card of this type can be integrated to a high integration degree to conform with the miniaturized IC chips. However, the probing card of this type is defective in that the probe itself lacks an elasticity. If the probes are integrated to a high integration degree, the clearance between the adjacent probes is unduly small, with the result that the membrane fails to follow the difference in height among the various electrode pads formed on the IC chip. It follows that it is difficult for the probe to be brought into stable contact with the electrode pad on the IC chip.

The present invention is intended to overcome the difficulty described above.

An object of the present invention is provide a probing card capable of dealing with the difficulty that the electrode pads of the element are integrated to a high integration degree and the pitch between the adjacent electrodes is diminished because of the increased degree of integration of the elements and the increase in the number of target objects to be inspected simultaneously.

Another object of the present invention is to provide a probe card that permits all the probes to be brought into contact with the corresponding electrode pads even if the electrode pads are not uniform in height.

Another object of the present invention is to provide a probe card that permits performing inspection of a high reliability by achieving at least one of the objects described above.

Another object of the present invention is to provide a method of manufacturing a probe card that permits collectively forming probes corresponding electrode pads even if the electrode pads of the element are integrated to a high integration degree to make the arranging pitch of the electrode pads smaller.

Further, still another object of the present invention is to provide a method of manufacturing a probe card at a low manufacturing cost.

The other objects and advantages of the present invention will be described herein later and a part thereof is obvious from the disclosure herein or may be obtained by the practice of the present invention. These objects and advantages of the present invention may be realized by the combination of the particular means pointed out herein.

According to a first aspect of the present invention, there is provided a probe card having a plurality of probes that are brought into contact with at least one element formed on a target object to be inspected for inspecting the electrical characteristics of said element, said probe comprising:

- a thin film-like base section formed along the lower circumferential surface of an imaginary pyramid having at least a pyramidal top portion;
- a contact terminal section formed along the outer circumferential surface of the top portion of said imaginary pyramid; and
- at least one thin film-like joining section having a predetermined shape and serving to join said contact terminal section to said base section.

It is desirable for said joining section of at least one of said plural probes of the probe card to be shaped spiral such that the joining section extends from the base section to the contact terminal section along the outer circumferential surface of the imaginary pyramid.

It is also desirable for said joining section of at least one of said plural probes of the probe card to be shaped linear such that the joining section extends from the base section to the contact terminal section along the outer circumferential surface of the imaginary pyramid.

It is also desirable for the base section of the probe card to be formed frame-like along the entire circumferential surface at the lower portion of the imaginary pyramid.

It is also desirable for the plural probes of the probe card to have their shapes selected in accordance with the positions of the probe card at which these probes are arranged.

According to a second aspect of the present invention, there is provided a method of manufacturing a probe card provided with a contactor having a plurality of probes of predetermined shapes that are brought into contact with at least one element formed in a target object to be inspected for inspecting the electrical characteristics of said element, comprising the steps of:

(a) forming a plurality of concave portions on the surface of a substrate, said concave portions being arranged to conform with said probes and shaped pyramidal in at least the top portions;

(b) filling a molding material in each of said concave portions, followed by solidifying the molding material so as to form a plurality of molded bodies having at least the top portions shaped pyramidal;

(c) transferring each of the molded bodies formed on the substrate onto the electrodes arranged on said contactor;

(d) forming an underlying metal thin film on the outer circumferential surface of every molded body transferred onto the contactor (e) forming a resist film on the underlying metal thin film formed on the outer circumferential surface of the molded body;

(f) removing that portion of the resist film formed on the underlying metal thin film in which said probe is to be formed;

(g) forming a conductive metal thin film for forming a probe on the outer circumferential surface of the molded body; and (h) removing the resist film remaining on the molded body, the metal thin film formed on the resist film for forming the probe, at least that portion of the underlying metal thin film which is positioned below the resist film, and the molding material.

In the manufacturing method of the probe card of the present invention, it is desirable for the plural probes to have a base section, a contact terminal section, and a joining section for joining the base section and the contact terminal section. It is also desirable for the joining section to be shaped spiral and to extend from the base section to the contact terminal section along the outer circumferential surface of the molded body.

In the manufacturing method of the probe card of the present invention, it is desirable for the plural probes to have a base section, a contact terminal section, and a joining section for joining the base section and the contact terminal section, and also desirable for the joining section to be shaped linear and to extend from the base section to the contact terminal section along the outer circumferential surface of the molded body.

In the manufacturing method of the probe card of the present invention, it is desirable for the plural probes to comprise a base section, a contact terminal section and a joining section for joining the base section and the contact terminal section, and also desirable for the base section to be formed frame-like along the entire outer circumferential surface in the lower portion of the molded body.

According to a third aspect of the present invention, there is provided a method of manufacturing a probe card provided with a contactor having a plurality of probes of predetermined shapes that are brought into contact with at least one element formed in a target object to be inspected for inspecting the electrical characteristics of said element, comprising the steps of:

(a) forming a plurality of concave portions on the surface of a substrate, said concave portions being arranged to conform with said probes and shaped pyramidal in at least the top portions;

(b) forming a conductive metal thin film for forming the probe on the surface of each of said concave portions so as to form a plurality of probe members each having at least the top portion shaped pyramidal;

(c) transferring the probe members formed in the concave sections onto a plurality of electrodes arranged on the contactor; and (d) applying a laser processing to said probe member so as to form a probe having a predetermined shape.

In the method of the present invention for manufacturing the probe card, it is desirable for the conductive metal thin film for forming the probe member to be formed in said step (b) after formation of a thin film for peeling said probe member on the surface of each of said concave portions.

In the method of the present invention for manufacturing the probe card, it is desirable for said step (c) to include the process of removing the thin film for peeling with a solution so as to peel the probe member from the concave portion.

In the method of the present invention for manufacturing the probe card, it is desirable for said step (b) to include the process, after formation of a conductive metal thin film for forming a probe on the surface of each concave portion, of forming a metal thin film for forming the probe in the peripheral portion of the concave portion and of forming a conductive metal thin film for fixation for improving the bonding strength between the conductive metal thin film and each of the plural electrodes arranged on the contactor.

In the method of the present invention for manufacturing the probe card, it is desirable for each of the probes to have a base section, a contact terminal section and a joining section for joining the base section and the contact terminal section and also desirable for the joining section to extend from the base section to the contact terminal section along the outer circumferential surface of the probe member and to be shaped spiral.

In the method of the present invention for manufacturing the probe card, it is desirable for each of the probes to have a base section, a contact terminal section and a joining section for joining the base section and the contact terminal section and also desirable for the joining section to extend from the base section to the contact terminal section along the outer circumferential surface of the probe member and to be shaped linear.

Further, in the method of the present invention for manufacturing the probe card, it is desirable for each of the probes to have a base section, a contact terminal section and a joining section for joining the base section and the contact terminal section and also desirable for the base section to be formed frame-like along the entire outer circumferential surface in a lower portion of the probe member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 10A to 10F are plan views each showing a probe of a probe card according to another embodiment of the present invention;

DETAILED DESCRIPTION OF THE INVENTION

Figure 1:
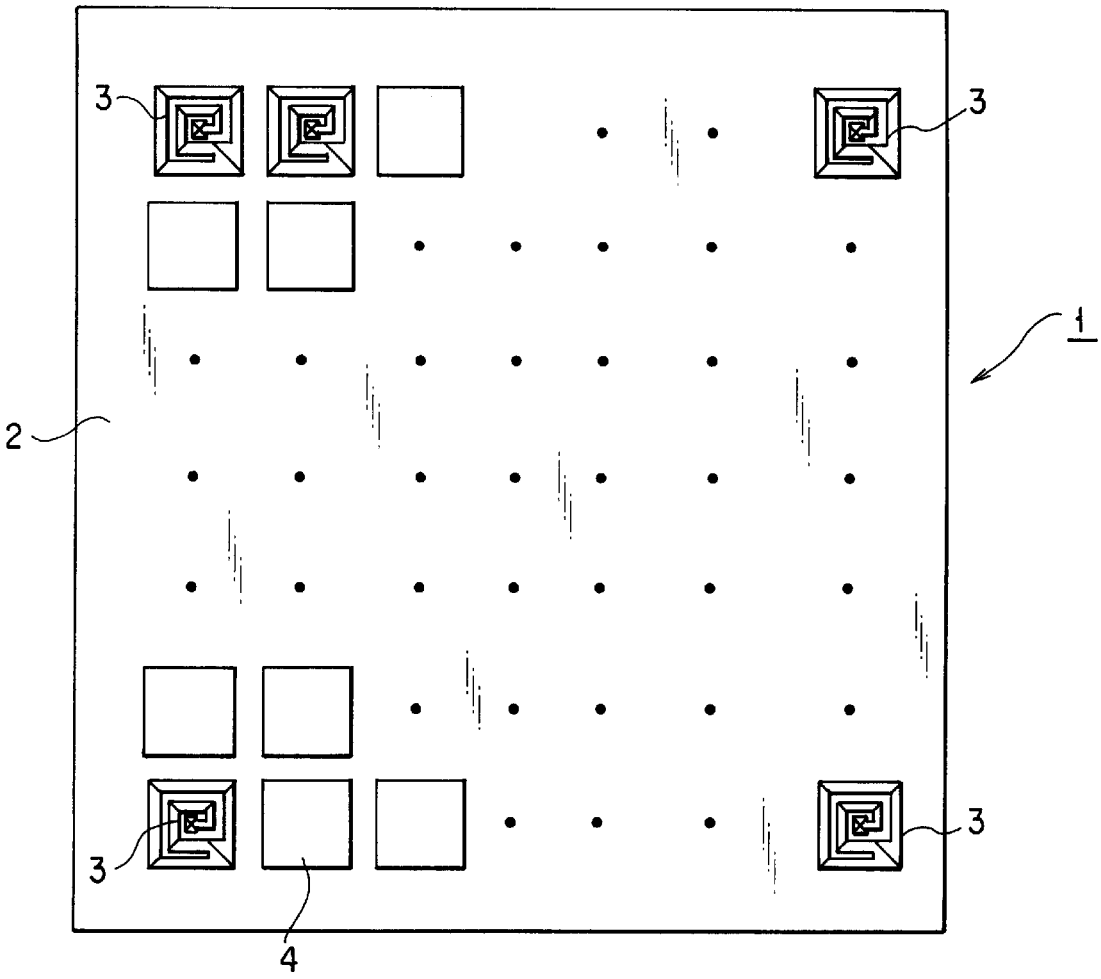
FIG. 1 is a plan view schematically showing a contactor according to one embodiment of the probe card of the present invention.

The present invention relates to a probe card and a method of manufacturing the same. The apparatus to which the probe card of the present invention is applied is not limited to a probe apparatus for inspecting the electrical characteristics of an integrated circuit formed on a wafer. The probe card of the present invention can also be applied to a probe apparatus for inspecting the electrical characteristics of a general electronic circuit part including an LCD. Further, the present invention also relates to a method of manufacturing a probe card. However, the following description covers the case where the technical idea of the present invention is applied to a probe apparatus for inspecting the electrical characteristics of an IC chip formed on a wafer in order to explain specifically the present invention.

The present invention will now be described based on the embodiments shown in FIGS. 1 to 11. The probe card in this embodiment comprises a contactor 1 shown in FIG. 1. As shown in the drawing, the contactor 1 comprises an insulating substrate 2, a plurality of electrode pads 4 formed on the front surface of the insulating substrate 2, and probes 3 formed on the electrode pads 4. These electrode pads 4 are arranged to conform with a plurality of electrodes of a target object to be inspected, i.e., an IC chip. The number of electrode pads 4 or probes 3 is, for example, about 2,000. The contactor 1 permits inspecting a plurality of IC chips simultaneously. The insulating substrate 2 consists of a ceramic sheet including a plurality of wiring layers laminated one upon the other.

Figure 2A:
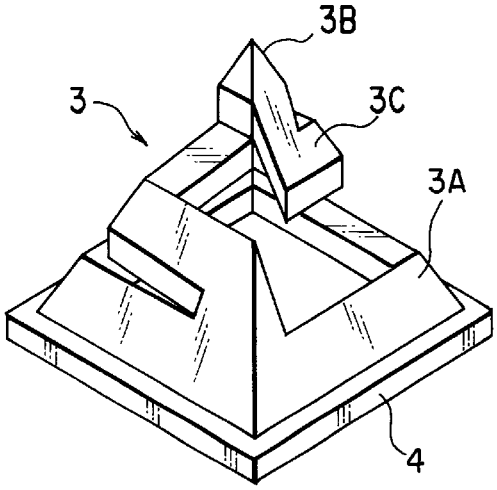
FIG. 2A is an oblique view showing in a magnified fashion a probe of the probe card shown in FIG. 1.
Figure 2B:
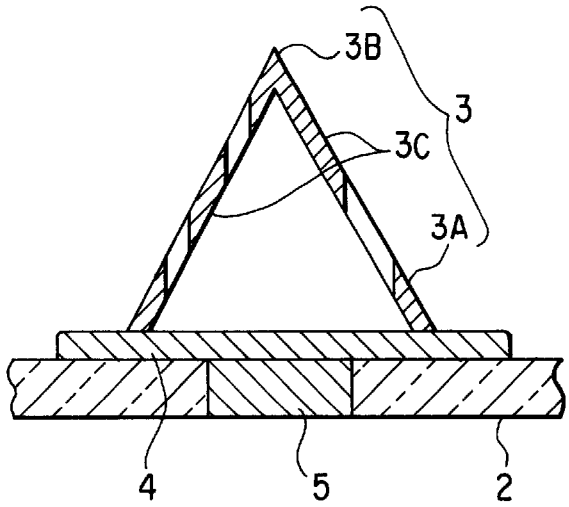
FIG. 2B is a cross sectional view showing in a magnified fashion a probe of the probe card shown in FIG. 1.
Figure 2C:
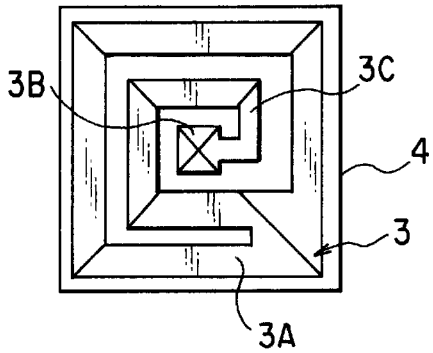
FIG. 2C is a plan view showing in a magnified fashion a probe of the probe card shown in FIG. 1.

As shown in FIGS. 2A to 2C, the probes 3 comprises a thin film-like base section 3A substantially in the form of a square frame, a thin film-like contact terminal section 3B arranged on a vertical line passing through the center of the substantially square frame-like base section 3A and shaped pyramidal, and a thin film-like joining section 3C for joining the contact terminal section 3B and the base section 3A. The base section is shaped substantially square in the drawing. However, it is possible for the base section to have another shape such as a triangular shape. An elastic conductive metal film can be used as the metal film for forming the probe. For example, it is possible to use a thin film of nickel or a nickel alloy as the thin film for forming the probe. The base section 3A, the contact terminal section 3B and the joining section 3C can be formed integral with substantially the same thickness.

As described herein later, the base section 3A can be formed along the outer surface in a lower portion of an imaginary pyramid having at least the top portion shaped like a pyramid. The contact terminal section 3B can be formed in the shape of a pyramid along the outer surface of the top portion of said imaginary pyramid. Further, the joining section 3C can be formed in the form of a spiral extending from one corner portion of the base section 3A to the contact terminal section 3B along the outer surface of the imaginary pyramid.

The shape of the joining portion is not limited to the spiral shape. As described herein later, the joining section 3C can be of various shapes. The entire circumferential outer surface of the base section 3A is electrically connected to the electrode pad 4, e.g., a Au/Ni plating having a thickness of 5 $\mu$m, for ensuring the electrical connection therebetween and for stably supporting the contact terminal section 3B and the joining section 3C. The contact terminal section 3B is supported by the joining section 3C such that the contact terminal section 3B is elastically movable in a vertical direction right above the center of the base section 3A. The contact terminal section 3B absorbs the difference in height among the inspecting electrode pads formed on the wafer. Also, the tip of the contact terminal 3B bites the electrode pad (not shown) formed on the wafer so as to ensure an electrical connection to the electrode pad. A reference numeral 5 shown in FIG. 2B represents a wiring for connecting the multi-layered wiring 6 (shown in FIG. 5) formed within the insulating substrate 2.

The length of one side of the base section 3A connected to the electrode pad 4 can be set at, for example, 100 $\mu$m. The height of the contact terminal section 3B from the surface of the electrode pad 4 can be set at, for example, 70 $\mu$m. Further, the thickness of each of the base section 3A, the contact terminal section 3B and the joining section 3C can be set at, for example, 10 $\mu$m.

The manufacturing method of the probe card described above will now be described. In the manufacture of the probe card in this embodiment, the insulating substrate 2 is formed, and a plurality of electrode pads 4 arranged to form a matrix are formed on the surface of the insulating substrate 2. Then, the probes 3 are arranged on the electrode pads 4. How to collectively form the probes 3 on the electrode pads will now be described.

Figure 3:
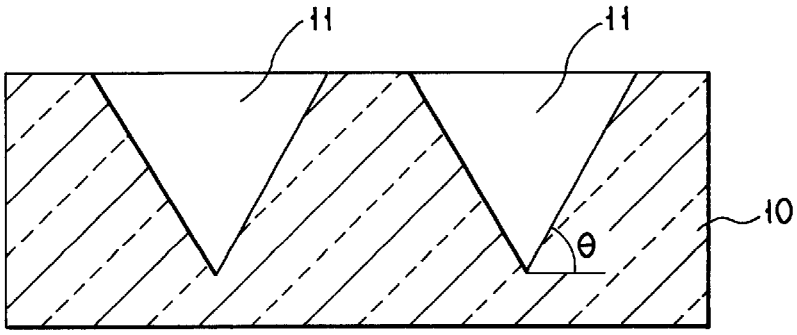
FIG. 3 is a cross sectional view showing a silicon wafer in the process of forming a concave portion for preparation of a probe member, which is included in the manufacturing process of a probe card of the present invention.

As shown in FIG. 3, inverted pyramidal concave portions 11 are collectively formed in the positions conforming with the arrangement of the electrode pads 4 on the surface of a silicon wafer 10 by a conventional anisotropic etching. The concave portion may be shaped such that at least the bottom portion thereof is in the form of, for example, an inverted square pyramid or a triangular pyramid. The angle θ made between the side surface of the concave portion 11 and the horizontal plane is defined by the crystal structure of the silicon wafer 10. For example, the angle θ was 54.7° in the silicon wafer 10 having a planar direction (100), which is was used in this embodiment.

Figure 4:
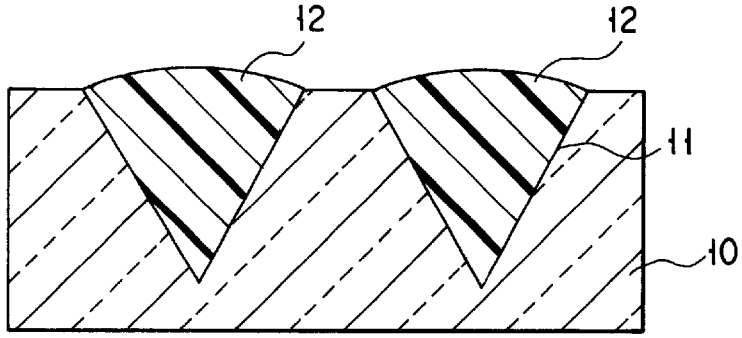
FIG. 4 is a cross sectional view showing the step of loading a molding material in the concave portion shown in FIG. 3.
Figure 5:
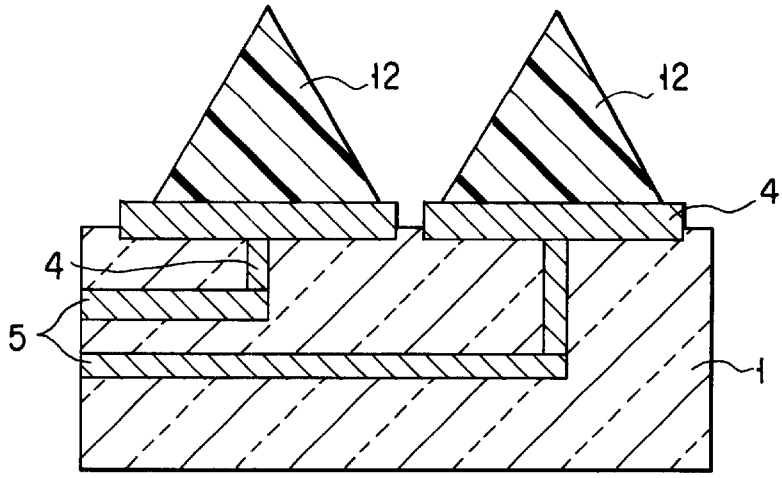
FIG. 5 is a cross sectional view showing the process of transferring the molded body shown in FIG. 4 onto an insulating substrate.
Figure 6:
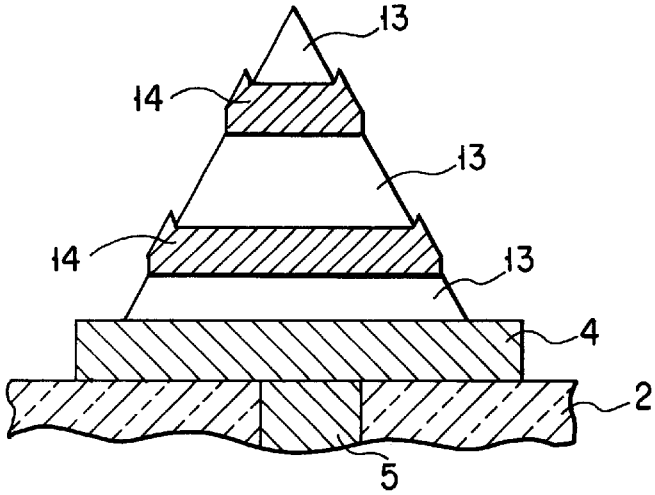
FIG. 6 is a side view showing the process of forming a resist film and an underlying metal thin film on the molded body shown in FIG. 5.
Figure 7:
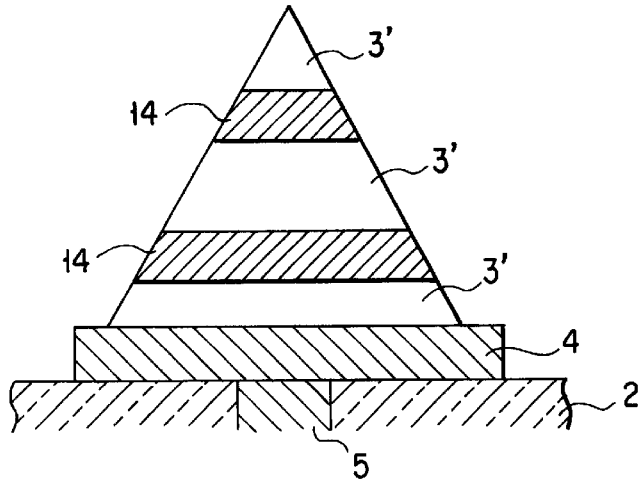
FIG. 7 shows the process of forming a metal thin film for a probe on the molded body shown in FIG. 6.

In the next step, the concave portion 11 is loaded with a molding material, e.g., resin, followed by solidifying the molding material, with the result that a square pyramidal molded body (imaginary pyramid) 12 providing the basic shape of the probes 3 is formed within the concave portion of the silicon wafer 10, as shown in FIG. 4. The molded bodies are aligned with the electrode pads 4 formed in advance on the insulating substrate 2, followed by superposing the silicon wafer 10 and the insulating substrate 2 one upon the other. Under this condition, the molded bodies 12 are collectively transferred onto the electrode pads 14, as shown in FIG. 5. Incidentally, the cross section of the structure consisting of the silicon wafer and the molded body 12 is shown in each of FIGS. 3 to 6, and a single molded body 12 is shown in each of FIGS. 6 to 9 that are to be explained in the following. Also, the cross section of the insulating substrate 2 and the side surface of the probe portion are shown in each of FIGS. 6 to 9.

An underlying metal thin film, e.g., gold, 13 is formed on the entire circumferential surface of each of the molded body 12. The metal thin film 13 thus formed plays the role of an electrode in the step of applying a metal plating for the probe. After a resist film 14 is formed on the entire surface of the metal thin film 13, the resist film is developed, with the result that the resist film 14 in the portion of forming the probes 3 is removed so as to expose the underlying metal thin film 13.

Figure 8:
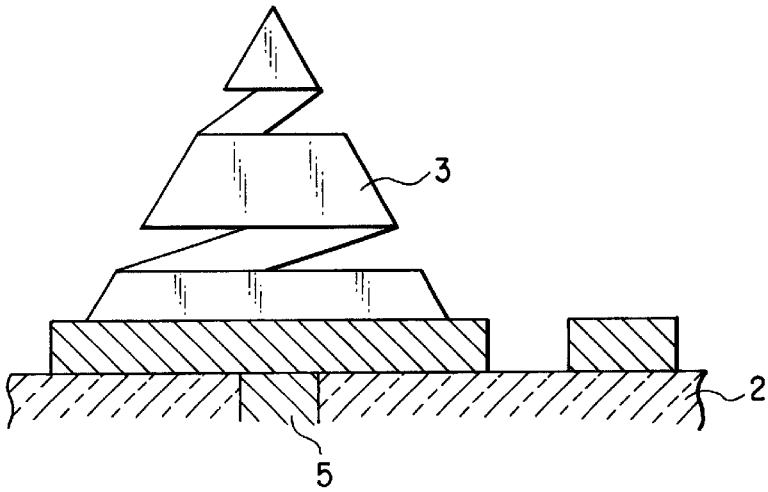
FIG. 8 shows the process of removing the resist film, the underlying metal thin film and the molded body from the state shown in FIG. 7.

In the next step, a metal thin film, e.g., a nickel plating, for forming the probe is formed by using the underlying metal thin film 13 as a cathode. A metal thin film 3' for forming the probe, which consists of nickel, is formed on the surface of the underlying metal film 13. In this step, the portion where the probe is to be formed is of a laminate structure consisting of the underlying metal thin film 13 and the metal thin film 3' for forming the probe. The other portion is of a laminate structure consisting of the underlying metal thin film 13 and the resist film 14. In the next step, the resist film 14 is dissolved in a chemical solution so as to be removed, and the metal thin film 13 positioned below the resist layer is removed by etching so as to expose the molded body 12. Further, the molded body 12 is dissolved in a chemical solution so as to be removed, thereby forming finally the probes 3 as shown in FIG. 8.

The operation of the probes 3 will now be described. Specifically, the probes 3 of the probe card are aligned with the electrode pads of each IC chip formed on the wafer within the probe apparatus. Then, the main chuck supporting the wafer is moved upward so as to bring the electrode pads for several IC chips formed on the wafer into contact with the probes 3 of the contactor 1. Further, the main chuck is over-driven so as to cause the contact terminal section 3B of the probes 3 to be elastically pushed toward the base section 3A through the joining section 3C. In this step, the difference in height of the electrode pads is absorbed by the elastic deformation of the joining section 3C even if the inspecting electrode pads of the IC chip are not uniform in height because the joining section 3C is elastically deformed in accordance with the height of each electrode pad. Further, the spring force of the joining section 3C permits the tip of the contact terminal section 3B to bite each electrode pad so as to ensure an electrical connection with the electrode pad and, thus, to make the inspection of the IC chip possible. After completion of the inspection, the main chuck is moved downward and in an X- or Y-direction so as to transfer the wafer into the index. Then, a plurality of IC chips are inspected.

As described above, according to the probe card in this embodiment, the probes 3 comprises a thin film-like frame-like base section formed along the outer circumferential surface in a lower portion of an imaginary pyramid having at least the top formed shaped pyramidal, a contact terminal section formed along the outer circumferential surface at the portion of the imaginary pyramid, and a thin film-like joining section having a predetermined shape and serving to join the contact terminal section to the base section. The particular construction makes it possible to increase the density of the electrode pads of an IC chip, to diminish the arranging pitch of the electrode pads, and to permit all the probes 3 to be brought into contact with the electrode pads without fail even if the electrode pads are not uniform in height. It follows that it is possible to perform inspection of a high reliability.

It should also be noted that the manufacturing method of a probe card in this embodiment makes it possible to form collectively the probes 3 conforming with the electrode pads on the insulating substrate 2, even if the density of the electrode pads on the IC chip is increased to shorten the arranging pitch of the electrode pads. According to the present invention, the probe card can be manufactured at a low manufacturing cost.

Probe cards according to other embodiments of the present invention will now be described with reference to FIGS. 9A, 9B and 10A to 10F. These probe cards can be manufactured by the manufacturing method described previously.

Figure 9A:
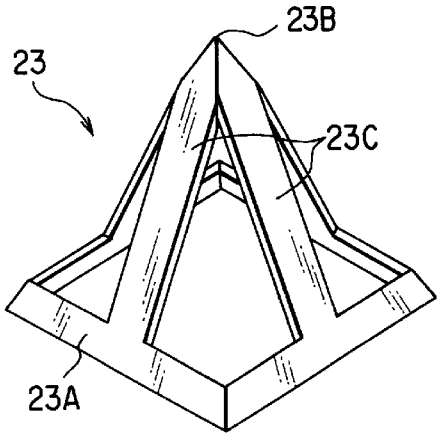
FIG. 9A is an oblique view showing in a magnified fashion a probe according to another embodiment of the probe card of the present invention.
Figure 9B:
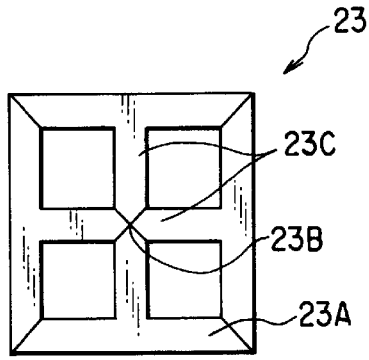
FIG. 9B is a plan view showing in a magnified fashion a probe according to another embodiment of the probe card of the present invention.

FIGS. 9A and 9B are an oblique view and a plan view, respectively, showing in a magnified fashion a probe 23 of the probe card according to another embodiment of the present invention. The probe 23 in this embodiment is substantially equal in construction to the probes 3 of the first embodiment, except that the probe 23 in this embodiment comprises a base section 23A, a contact terminal section 23B and four joining sections 23C for joining the base section 23A to the terminal contact section 23B. Each of these four joining sections 23C is formed straight and serves to join the center of each side of the square base section 23A to the contact terminal 23B. Each joining section 23C extends along each side surface of the molded body 12. The contact terminal 23B is elastically brought into contact with the inspecting electrode pad via the joining section 23C in this embodiment, too, so as to produce the function and effect similar to those produced by the first embodiment.

FIGS. 10A to 10F are plan views each showing in a magnified fashion the probe of a probe card according to other embodiments of the present invention. These probes are equal to the probe of the embodiment described above except the construction of the joining section. Specifically, in the probes 3 shown in FIG. 10A, the base section 33A is joined to the contact terminal section 33B via four joining sections 33C, as in the embodiment shown in FIG. 9. The embodiment shown in FIG. 10A differs from the embodiment shown in FIGS. 9A and 9B in that the joining sections are joined to points near the corner portions of the base section 33A in FIG. 10A. In the probe 43 of the embodiment shown in FIG. 10B, the base section 43A is joined to the contact terminal section 43B via four joining sections 43C as in the embodiment shown in FIG. 9. Likewise, in the probe 53 of the embodiment shown in FIG. 10C, the base section 53A is joined to the contact terminal section 53B via four joining sections 53C as in the embodiment shown in FIG. 9. The embodiments shown in FIGS. 10B and 10C differ from the embodiment shown in FIG. 9 in that the joining sections 43C, 53C spirally extend from the centers of the sides of the base sections 43A, 53A so as to be joined to the contact terminal sections 43B, 53B in the embodiments shown in FIGS. 10B and 10C. In the probe 63 shown in FIG. 10D, the center of one side of the base section 63A is joined to the contact terminal section 63B via a single joining section 63C. The embodiment shown in FIG. 10D differs from the embodiment shown in FIG. 2 in that the joining section 63C extends straight in the embodiment shown in FIG. 10D. The probe 73 shown in FIG. 10E differs from the probe 63 shown in FIG. 10D in that, in FIG. 10E, the centers of the mutually facing sides of the base section 73A are joined to the contact terminal section 73B via two joining sections 73C. The centers of the mutually facing sides of the base section 83A are joined to the contact terminal section 83B via two joining sections 83C in the probe 83 shown in FIG. 10F, too, though each of these joining sections 83C extends spiral in the embodiment shown in FIG. 10F. The embodiments shown in FIGS. 10A to 10F also produce the function and effect similar to those produced by the probes of the other embodiments described previously.

Each of the embodiments described above is directed to a square pyramidal probe. However, the probe may have a triangular pyramidal shape, a conical shape, etc., as required. It is also possible for the joining section to have various shapes, as required. Further, the material of the molded body 12 is not limited to resin. For example, it is possible to use a metal such as copper for forming the molded body 12.

Another method of the present invention for manufacturing a probe will now be described with reference to FIGS. 3 and 11A to 11E. This manufacturing method utilizes a laser processing technology for forming the probe.

As described previously in conjunction with FIG. 3, concave portions, e.g., concave portions each having an inverted pyramidal shape, 11 are formed collectively by the known anisotropic etching method in that positions of the surface of the silicon wafer 10 which correspond to the arrangement of the electrode pads 4.

Figure 11A:
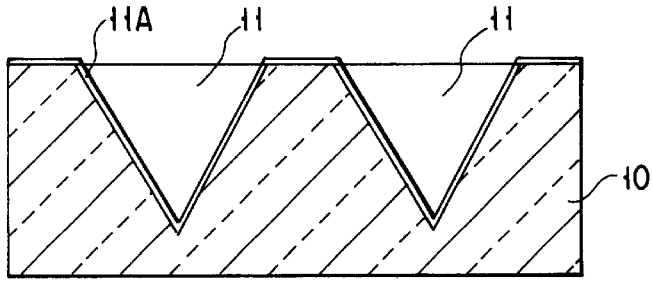
FIGS. 11A to 11E collectively show the probe manufacturing process using a laser technology.
Figure 11B:
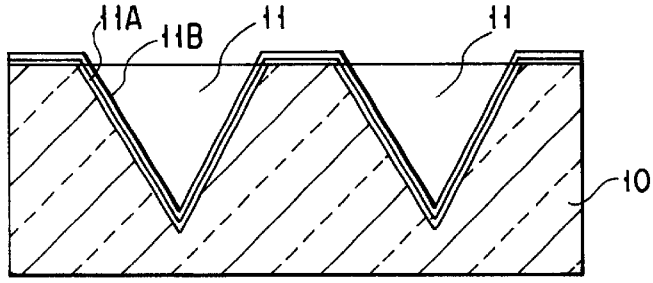

As shown in FIG. 11A, a thin film 11A for peeling, e.g., a Cu thin film having a thickness of 2 $\mu$m, is formed on the surface of the silicon wafer 10. Then, a conductive metal thin film 11B for forming a probe is formed on the thin film 11A for peeling, as shown in FIG. 11B. The thin film 11B for forming the probe may consist of, for example, a Ni film having a thickness of 5 $\mu$m. It is desirable to form the thin film 11A for peeling in order to permit the metal thin film 11B for forming the probe to be peeled easily from the concave portion. However, it is not absolutely necessary to form the thin film 11A for peeling.

Figure 11C:
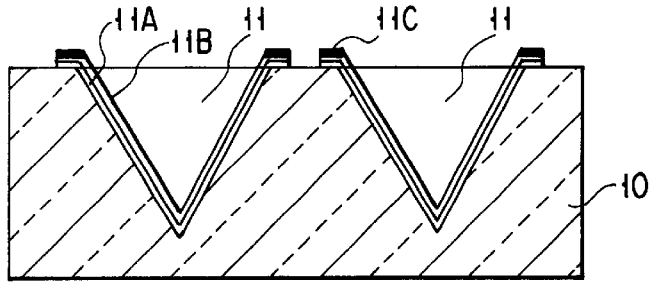

In the next step, a metal thin film 11C for fixation is formed in the peripheral portion of the concave portion 11, as shown in FIG. 11C. Further, the thin film 11A for peeling and the metal thin film 11B for forming the probe are removed from the peripheral portion of the concave portion 11 except the portion where the metal thin film 11C for fixation is formed. The metal thin film 11C for fixation is formed in order to improve the bonding strength between the metal thin film for forming the probe and each of a plurality of electrodes arranged on the contactor. It is desirable to form the metal thin film 11C for fixation in order to improve the bonding strength noted above. However, it is not absolutely necessary to form the metal thin film 11C for fixation.

Figure 11D:
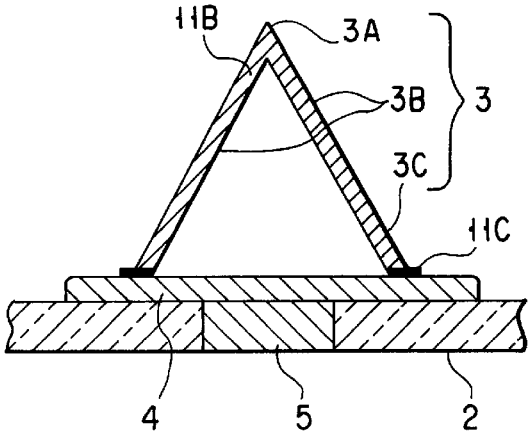

In the next step, the metal thin film 11A for peeling is dissolved in a chemical solution, e.g., a 40% aqueous solution of iron chloride, so as to be removed, with the result that the metal thin film for forming the probe is in condition for withdrawal from the concave portion. The wafer 10 thus formed is aligned with the contactor and, then, the wafer 10 and the contactor are superposed one upon the other. Further, the probe member consisting of the thin films 11B and 11C is transferred onto the electrode pad 4 formed on the contactor, as shown in FIG. 11D.

Figure 11E:
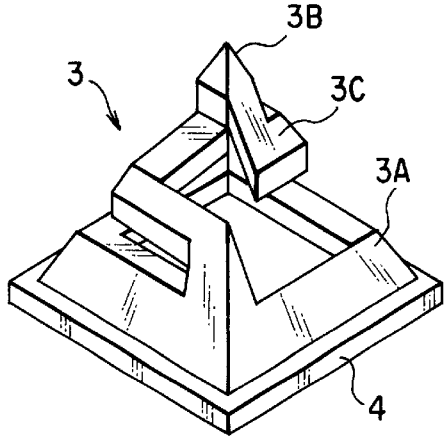
Figure 12:
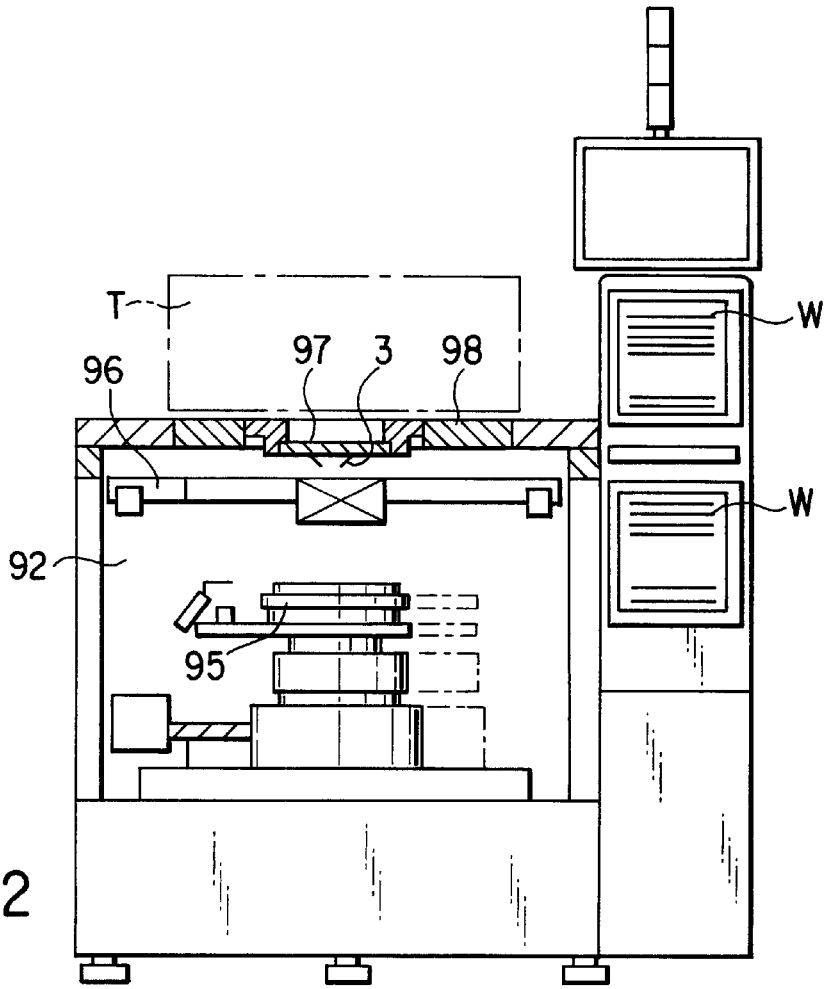
FIG. 12 is a front view, partly broken away, showing a probing chamber of a conventional probe apparatus.
Figure 13:
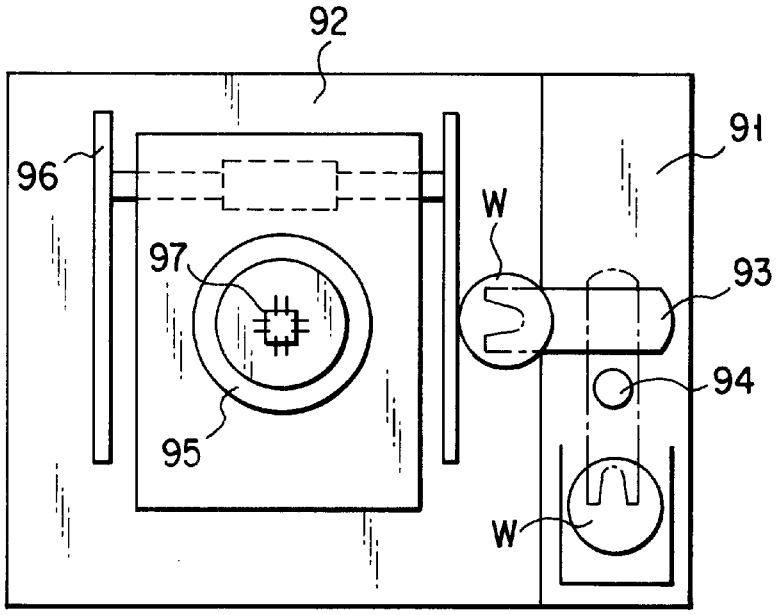
FIG. 13 is a plan view showing the inner construction of the probe apparatus shown in FIG. 12.

Finally, as shown in FIG. 11E, the probe member fixed to the contactor 2 is processed into a desired shape, e.g., spiral shape, by a laser processing technology, e.g., processing technology by excimer laser.

According to the manufacturing method shown in FIGS. 3 and 11A to 11E, it is possible to manufacture accurately and promptly a probe according to the probe card of the present invention.

To reiterate, the degree of integration of the element is markedly enhanced and the number of target objects to be inspected simultaneously is markedly increased nowadays. According to the present invention, the probes can be integrated to a high degree of integration in accordance with the increase in the number of electrodes of the element and increase in the degree of integration and in accordance with the arrangement of the electrodes. Also, the number of arrangements can be increased. Further, the present invention provides a probe card that permits all the probes to be brought into contact with the electrodes of the element without fail, making it possible to perform inspection with a high reliability.

According to the present invention, it is possible to cope with the increase in the number of electrodes of the element and the enhanced degree of integration accompanying the enhancement of the degree of integration of the element and the increase in the number of target objects to be inspected simultaneously by collectively forming the probes corresponding to these electrode pads on an insulating substrate. According to the present invention, the probe card can be manufactured with a low manufacturing cost.

In the present invention, it is possible for all the probes of the probe card to have the same shape. Alternatively, it is also possible for the shapes of the probes to be changed in accordance with the positions arranged on the contactor.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A prove card having a plurality of probes that are brought into contact with at least one element formed on a target object to be inspected for inspecting electrical characteristics of said element, said probe comprising:

a thin film-like base section formed along the lower circumferential surface of an imaginary pyramid having at least a pyramidal top portion;

a contact terminal section formed along the outer circumferential surface of the top portion of said imaginary pyramid; and at least one thin film-like joining section having a predetermined shape and serving to join said contact terminal section to said base section;

wherein said joining section of at least one of said plural probes of the probe card is shaped spiral such that the joining section extends from the base section to the contact terminal section along the outer circumferential surface of the imaginary pyramid.

2. The probe card according to claim 1, wherein said joining section of at least one of said plural probes of the probe card is shaped linear such that the joining section extends from the base section to the contact terminal section along the outer circumferential surface of the imaginary pyramid.

3. The probe card according to claim 1, wherein the base section of the probe card is formed frame-like along the entire circumferential surface at the lower portion of the imaginary pyramid.

4. The probe card according to claim 1, wherein the plural probes of the probe card have their shapes selected in accordance with the positions of the probe card at which these probes are arranged.

5. The probe card according to claim 1, wherein the contact terminal section of the spiral joining section is shaped as an inverted square pyramid or a triangular pyramid.

* * * * *